US011535044B2

(12) United States Patent
Hamada et al.

(10) Patent No.: US 11,535,044 B2
(45) Date of Patent: Dec. 27, 2022

(54) PRINTING APPARATUS AND CONTROL METHOD

(71) Applicant: CANON KABUSHIKI KAISHA, Tokyo (JP)

(72) Inventors: Takuya Hamada, Kanagawa (JP); Kenichi Ogawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 1 day.

(21) Appl. No.: 17/033,389

(22) Filed: Sep. 25, 2020

(65) Prior Publication Data

US 2021/0094327 A1 Apr. 1, 2021

(30) Foreign Application Priority Data

Sep. 30, 2019 (JP) ..... JP2019-180290

(51) Int. Cl.
*B41J 29/38* (2006.01)
*B41J 13/00* (2006.01)
*B41J 11/00* (2006.01)

(52) U.S. Cl.
CPC ..... *B41J 13/0009* (2013.01); *B41J 11/002* (2013.01)

(58) Field of Classification Search
None
See application file for complete search history.

(56) References Cited

U.S. PATENT DOCUMENTS 5,323,176 A * 6/1994 Sugiura ..... B41J 13/009 346/25
2010/0060693 A1* 3/2010 Sugahara ..... B41J 13/223 347/16
2016/0152845 A1* 6/2016 Okada ..... C09D 11/322 524/386

FOREIGN PATENT DOCUMENTS

JP 2008170567 A * 7/2008
JP 2011-212938 A 10/2011
JP 2011-225315 A 11/2011
JP 2013208781 A * 10/2013 ..... B41J 11/0015

* cited by examiner

*Primary Examiner* — Erica S Lin
*Assistant Examiner* — Tracey M McMillion
(74) *Attorney, Agent, or Firm* — Canon U.S.A., Inc. I.P. Division

(57) ABSTRACT

A printing apparatus includes a conveyance unit, a printing unit, and a heating unit provided on a downstream side with respect to the printing unit in the conveyance direction, and a control unit. The conveyance unit conveys a printing medium along a conveyance direction. The printing unit ejects ink onto the printing medium conveyed by the conveyance unit. The heating unit heats the printing medium on which ink has been ejected by the printing unit while being in contact therewith. The control unit controls the printing apparatus such that a first surface of the printing medium passes through the same heating unit a plurality of times, wherein the first surface includes ink having been ejected by the printing unit onto the first surface.

16 Claims, 7 Drawing Sheets

FIG.5

| OPERATION MODE | OPERATION | DETERMINATION CRITERIA |
| --- | --- | --- |
| FIRST OPERATION MODE | PRINTING MEDIUM IS MADE TO PASS THROUGH HEATING SECTION ONCE FOR ONE PRINTING OPERATION | PRINTING MEDIUM INTO WHICH INK PENETRATES RELATIVELY QUICKLY |
| SECOND OPERATION MODE | PRINTING MEDIUM IS MADE TO PASS THROUGH HEATING SECTION A PLURALITY OF TIMES FOR ONE PRINTING OPERATION | PRINTING MEDIUM INTO WHICH INK PENETRATES RELATIVELY SLOWLY HIGH COLOR DEVELOPING PRINTING MEDIUM |
| THIRD OPERATION MODE | THE NUMBER OF TIMES OF PASSING IS SET TO N (ANY NUMBER BY USER) | USER SPECIFIES THE NUMBER OF TIMES OF PASSING |

PRINTING APPARATUS AND CONTROL METHOD

BACKGROUND

Field

The present disclosure relates to a printing apparatus and a control method.

Description of the Related Art

Japanese Patent Application Laid-Open No. 2011-212938, for example, discusses a liquid ejecting apparatus in which a heating roller is provided on a downstream side with respect to an image forming section and a medium is conveyed with the heating roller being in contact with a surface of the medium. The liquid ejecting apparatus of Japanese Patent Application Laid-Open No. 2011-212938 is directed to improve abrasion resistance by heating, through the medium, ink containing a coloring material and polymer particles having film-forming property to form a film by the above-described configuration.

In Japanese Patent Application Laid-Open No. 2011-212938, on a printing medium having ink ejected thereon, evaporation of water or a solvent and film formation of polymer particles are performed simultaneously in one heating operation by the heating roller. However, with the configuration of Japanese Patent Application Laid-Open No. 2011-212938, in some cases, film formation is not sufficient and desired abrasion resistance is not exhibited because polymer particles are dissolved after liquid components such as water and solvent included in the ink are evaporated or penetrates into the printing medium, and film formation starts thereafter.

Japanese Patent Application Laid-Open No. 2011-225315 discusses a droplet ejecting apparatus in which a plurality of heating rollers is provided on a downstream side with respect to an image forming section in a conveyance direction. Since water and solvent are evaporated by a heating roller on an upstream side, and then the film formation of the polymer particles can be performed by the plurality of heating rollers, a desired abrasion resistance can be exhibited.

However, in Japanese Patent Application Laid-Open No. 2011-225315, the plurality of heating rollers is arranged in the conveyance direction to heat the printing medium, there is a possibility that the printing apparatus may become large.

SUMMARY

The present disclosure provides an advantageous technique for suppressing an increase in size of a printing apparatus including a heating mechanism of a printing medium.

According to an aspect of the present disclosure, a printing apparatus includes a conveyance unit configured to convey a printing medium along a conveyance direction, a printing unit configured to eject ink onto the printing medium conveyed by the conveyance unit, a heating unit that is provided on a downstream side with respect to the printing unit in the conveyance direction and is configured to heat the printing medium on which ink has been ejected by the printing unit while being in contact therewith, and a control unit configured to control the printing apparatus such that a first surface of the printing medium passes through the same heating unit a plurality of times, wherein the first surface includes ink having been ejected by the printing unit onto the first surface.

Further features of the present disclosure will become apparent from the following description of exemplary embodiments with reference to the attached drawings.

BRIEF DESCRIPTION OF THE DRAWINGS

FIG. 5 is a table indicating operation modes according to the second exemplary embodiment.

DESCRIPTION OF THE EMBODIMENTS

Hereinafter, exemplary embodiments of the present disclosure will be described for each of first to third exemplary embodiments.

<Configuration of Printing Apparatus>

Figure 1:
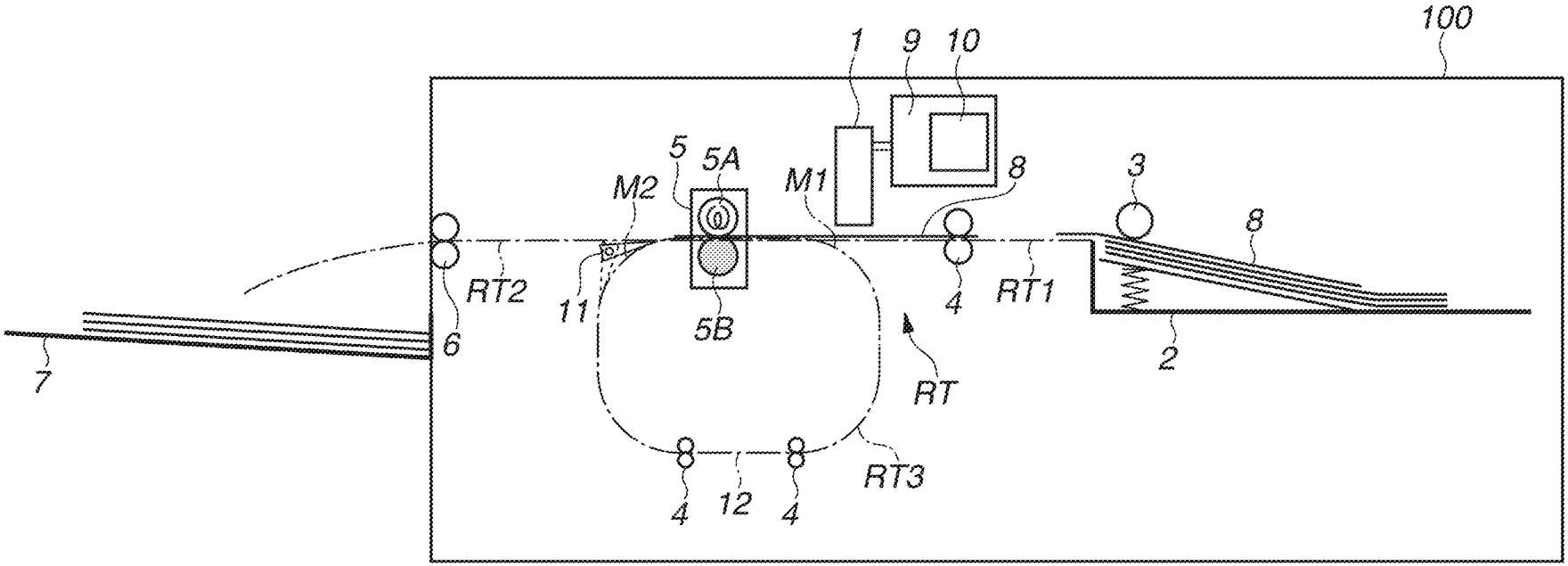
FIG. 1 is an overall view of a printing apparatus according to a first exemplary embodiment.

FIG. 1 is an overall view (cross-sectional view) of a printing apparatus 100 according to the first exemplary embodiment (an example of the inkjet printing apparatus, hereinafter referred to as the printing apparatus 100). The printing apparatus 100 is a printing apparatus using an inkjet method that forms an image on a printing medium 8 (an example of a medium) by applying ink as a recording agent to the printing medium 8.

As illustrated in FIG. 1, the printing apparatus 100 includes a printhead 1 (an example of a printing section) and a sheet feeding cassette 2. Further, the printing apparatus 100 includes a sheet feeding roller 3, a conveying unit 4 (an example of a conveying section), a heating section 5, sheet discharging rollers 6, a sheet discharge tray 7, a control unit 9, and an operating unit 10. The printing apparatus 100 further includes a conveyance route switching unit 11 and a conveyance route 12. The printhead 1 is a full-line type head (inkjet head) having an ejection port for ejecting ink. In the present specification, an example of the liquid droplet can be a liquid other than ink.

An operation of printing by the printing apparatus 100 according to this exemplary embodiment will be described. The printing medium 8 (an example of the medium) picked up from the sheet feeding cassette 2 by the sheet feeding roller 3 is conveyed in a conveyance direction by the conveying unit 4, and an image is formed by the printhead 1. The printing medium 8 on which an image is formed passes through the heating section 5 while the ink on the printing medium 8 is being dried in the heating section 5, is conveyed by the sheet discharging rollers 6, and then is stacked on the sheet discharge tray 7.

<Conveying Unit>

The conveying unit 4 is a mechanism that conveys the printing medium 8 along a conveyance route RT. The conveyance route RT includes main routes RT1 and RT2 and a sub route RT3. The main routes RT1 and RT2 are routes from the sheet feeding roller 3 to the sheet discharging rollers 6. The main route RT1 is from the sheet feeding roller 3 to a middle point M2, and the main route RT2 is from the middle point M2 to the sheet discharging rollers 6. The sub route RT3 is a route from the middle point M2 via the conveyance route 12 through the middle point M1 and back to the middle point M2. The conveyance route RT is formed between guide members provided along the conveyance direction.

The conveying unit 4 conveys the printing medium 8 along the conveyance route RT including a drive mechanism that applies a conveying force to the printing medium 8. The drive mechanism is a plurality of conveyance rollers driven by a drive source such as a motor. The plurality of conveyance rollers is arranged such that each of the conveyance rollers faces a follower roller or a spur. The printing medium 8 is conveyed while being sandwiched between the conveyance roller and the follower roller or the spur.

In the following description, the conveyance direction refers to a direction in which the printing medium 8 is conveyed in the conveyance route RT. When the terms "downstream side" and "upstream side" are used, the conveyance direction of the printing medium 8 in the conveyance route RT is used as a reference.

On the downstream side with respect to the heating section 5, the conveyance route switching unit 11 is provided. The conveyance route switching unit 11 is a unit that switches conveyance routes of the printing medium 8, and is operated by a drive source such as an electromagnetic solenoid or a motor. The conveyance route switching unit 11 guides the printing medium 8 from the main route RT1 to the main route RT2 in a case where heating is performed only once for one printing operation. On the other hand, in a case where heating is performed a plurality of times for one printing operation, the conveyance route switching unit 11 guides the printing medium 8 heated by the heating section 5 from the main route RT1 to the sub route RT3 so that the printing medium 8 is heated again by the heating section 5, and then guides the printing medium 8 to the main route RT2.

The printing apparatus 100 can be applied to apparatuses including a printer, a copying machine, a facsimile having a communication system, and a word processor having a printer unit. Further, the printing apparatus 100 can be applied to an industrial printing apparatus that is compositely combined with various processing apparatuses. For example, the printing apparatus 100 can be used for biochip production, printing of electronic circuits, semiconductor substrate production, a 3D printer, and the like.

<Control Unit>

Figure 2:
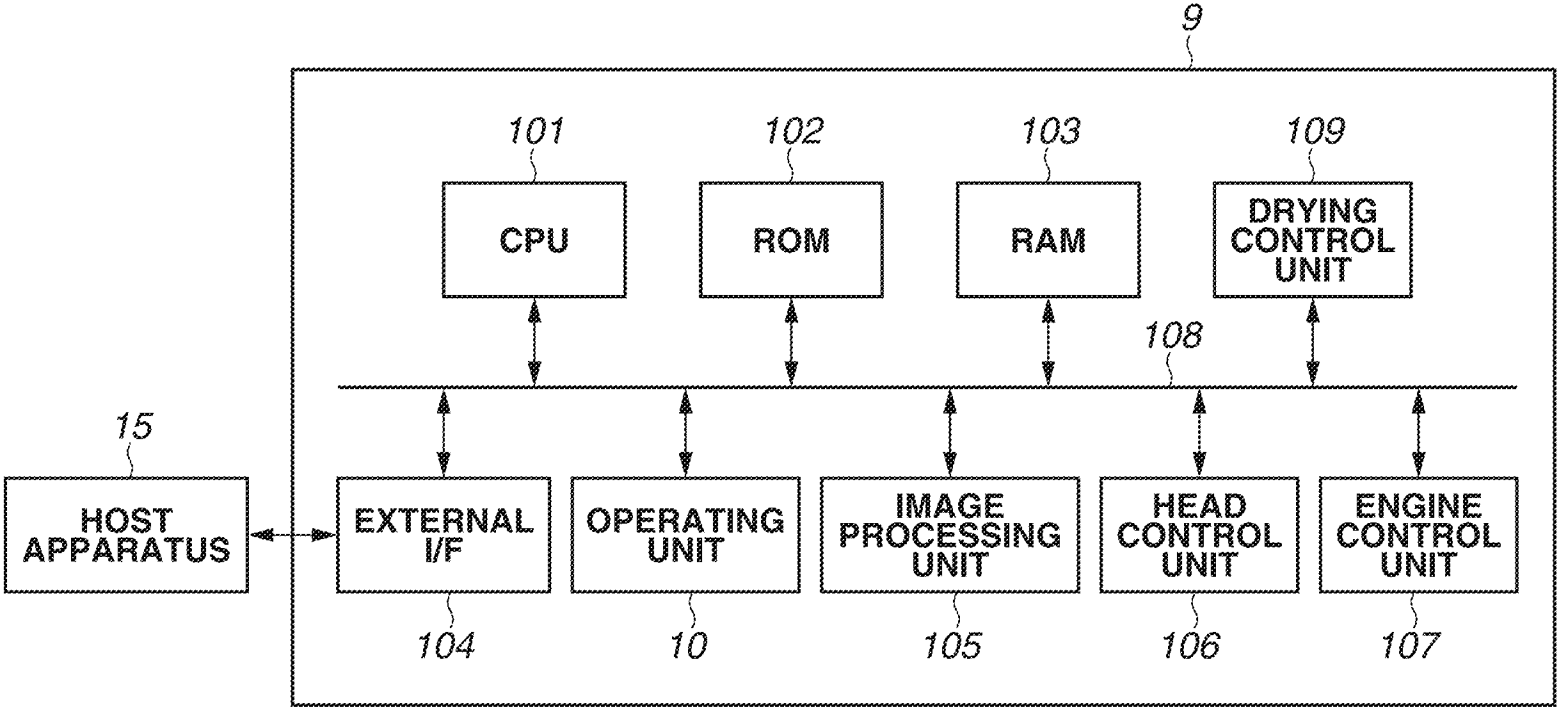
FIG. 2 is a block diagram of a control unit of the printing apparatus and a host apparatus according to the first exemplary embodiment.

FIG. 2 is a block diagram illustrating a concept of the control unit 9 configured to be communicable with a host apparatus 15. As an example, the control unit 9 includes a central processing unit (CPU) 101, a read only member (ROM) 102, a random access memory (RAM) 103 (an example of a memory unit), an image processing unit 105, a head control unit 106, an engine control unit 107, and a drying control unit 109.

The CPU 101 integrally controls an operation of each unit of the printing apparatus 100. The ROM 102 (memory unit) stores programs to be executed by the CPU 101 and fixed data (for example, data regarding a type of the printing medium 8 stored in the sheet feeding cassette 2) necessary for various operations of the printing apparatus 100. The RAM 103 stores various types of setting data as a work area of the CPU 101 or a temporary storage area for various types of received data. The operating unit 10 is an input/output interface with a user, and includes an input unit such as a hard key or a touch panel, and an output unit such as a display device for presenting information or a voice generator. A dedicated processing unit is provided for a unit that requires high-speed data processing. The image processing unit 105 performs image processing of image data handled by the printing apparatus 100. A color space (for example, YCbCr) of input image data is converted into a standard RGB color space (for example, sRGB). Print data obtained by the image processing described above is stored in the RAM 103. The head control unit 106 controls drive of the printhead 1 according to the print data based on a control command received from the CPU 101 or the like. The engine control unit 107 controls a conveyance mechanism in the printing apparatus and a heater of the heating section 5, and also controls the conveying unit 4, the sheet discharging rollers 6, and the conveyance route switching unit 11. The drying control unit 109 performs heating control and drive control of the heating section 5.

The operation of each unit is controlled by the engine control unit 107 based on instructions from the CPU 101. An external interface (I/F) 104 is an interface for connecting the control unit 9 to the host apparatus 15, and is a local I/F or a network I/F. The components described above are connected by a system bus 108.

The host apparatus 15 is a supply source of image data for causing the printing apparatus 100 to perform an image forming operation. The host apparatus 15 can be a general-purpose or dedicated computer, or a dedicated imaging device such as an image capturing device having an image reader unit, a digital camera, a photo storage, or the like.

<Heating Section>

Figure 3A:
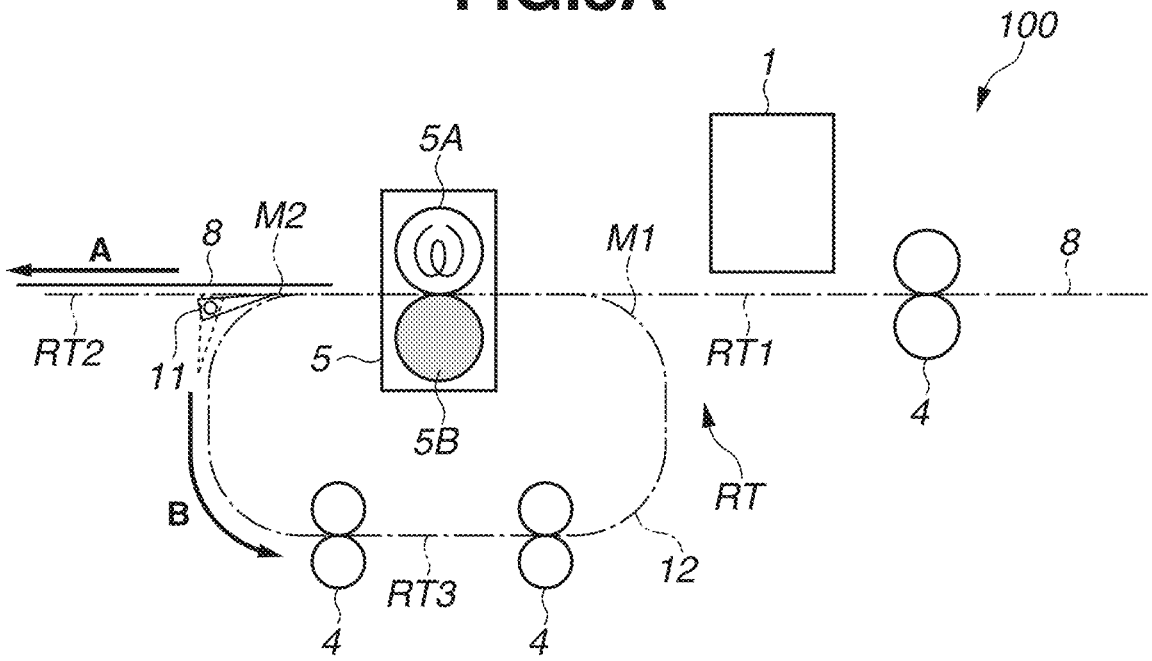
FIGS. 3A and 3B are enlarged views of an image forming section and an ink drying section according to the first exemplary embodiment.
Figure 3B:
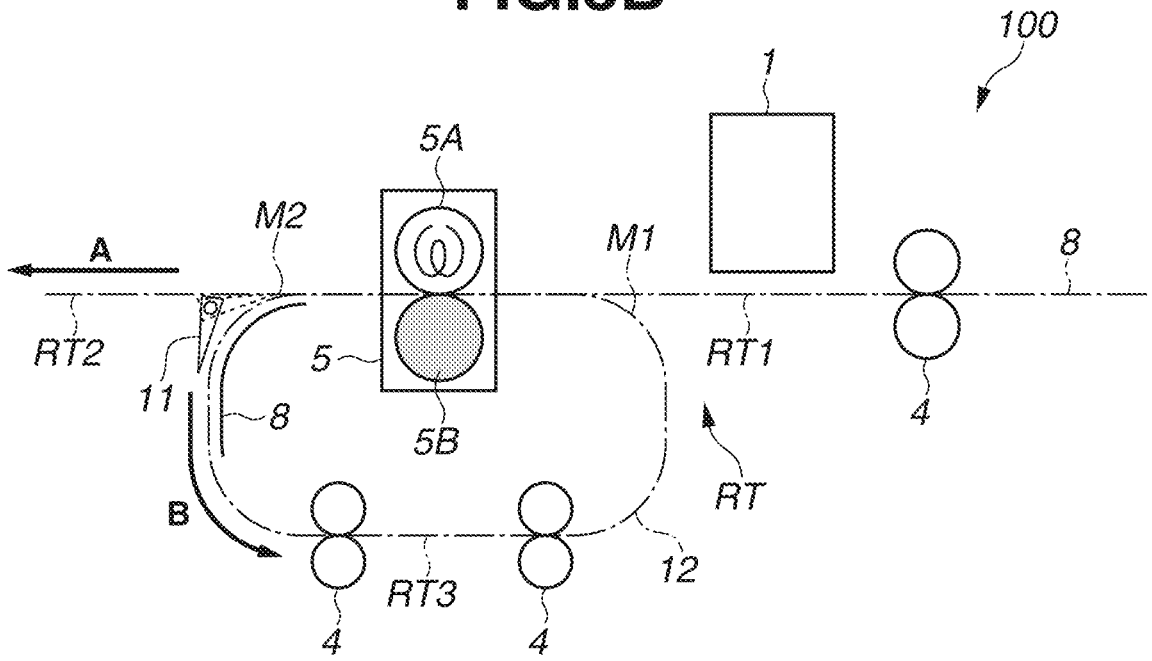

The heating section 5 is a heating unit to quickly dry ink droplets that have landed on a surface of the printing medium 8. The heating section 5 is provided on the downstream side with respect to the printhead 1 in the conveyance direction of the printing medium 8. The heating section 5 has a heat roller 5A and a pinch roller 5B as illustrated in FIGS. 3A and 3B. The heat roller 5A has a heating element (for example, a halogen heater) enclosed therein. The pinch roller 5B is arranged under the heat roller 5A and forms a nip with the heat roller 5A. The heat roller 5A and the pinch roller 5B are configured to pinch and convey the printing medium 8 at the nip while rotating in the opposite directions around a first axis and a second axis, respectively. With the configuration described above, the heating section 5 is configured to heat the printing surface of the printing medium 8 while being in contact with the surface of the printing medium 8 on which the ink has been ejected by the printhead 1.

The heat roller 5A used in the printing apparatus 100 of the present exemplary embodiment will be described. A dynamic surface tension of ink when ink droplets having landed on the printing medium 8 reach the heat roller 5A is made higher than a surface energy of a roller surface of the heat roller 5A. This suppresses transfer of ink to the heat roller 5A. As the material of the roller surface of the heat roller 5A, a film having heat resistance is preferable to efficiently treat water in a short time. For example, polyimide, perfluoroalkoxyalkane (PFA), polytetrafluoroethylene (PTFE), silicone, or the like can be used. The material of the roller surface of the heat roller 5A in the present exemplary embodiment is PFA=tetrafluoroethylene-perfluoroalkyl vinyl ether copolymer. As long as the ink and the heat roller 5A satisfy the relationship described above, the materials of the ink and the heat roller 5A can be other than those exemplified in this exemplary embodiment.

Each component of the ink used in the present exemplary embodiment will be described. The ink according to the present exemplary embodiment preferably contains water to have an appropriate viscosity for stable ejection of the ink and to suppress clogging at a nozzle tip. It is preferable to use deionized water (ion-exchanged water) as water. The content (% by mass) of water in the ink is preferably 30.0% by mass or more and 90.0% by mass or less with reference to the total mass of the ink.

In the present exemplary embodiment, in order to suppress curling when a sheet is discharged, it is required that the water in the ink has been sufficiently treated by the heating section of a contact-type at the time of sheet discharge. Therefore, it is preferable that the water content in the ink is reduced as much as possible taking account of a balance with the above-described ejection stability and reliability regarding clogging, and the like, and is more preferably in a range of 30.0% by mass or more and 70.0% by mass or less. In the present exemplary embodiment, a pigment dispersion liquid A (details described below), a water-dispersible resin dispersion liquid B (details described below), glycerin, 2-pyrrolidone, 1,2-hexanediol, and water are mixed in the ratio 50:20:10:10:3:7(%) as a colorant, the colorant is adjusted by the amount of adding surfactant: Acetylenol E-60 (product of Kawaken Fine Chemicals Co., Ltd.) so that the surface tension becomes 30 to 45 [mN/m], the resultant is agitated sufficiently, and then the mixture is filtered under pressure through a microfilter (product of Fuji Film Co., Ltd.) having a pore size of 3.0 μm to prepare an ink.

The preparation of the pigment dispersion liquid A will be described. 8.0 parts of a styrene-acrylic acid copolymer (water-soluble resin) having an acid value of 120 mgKOH/g and a weight average molecular weight of 8,000 is dissolved in ion-exchanged water with sodium hydroxide in such an amount that the neutralization equivalent is 1. To this solution, 20.0 parts of carbon black having a specific surface area of 220 $m^2/g$ and a Dibutyl Phthalate (DBP) oil absorption of 105 mL/100 g is added, and ion-exchanged water is further added up to 100 parts in total. This mixture is dispersed for 3 hours using a batch type vertical sand mill to obtain a dispersion liquid. The obtained dispersion liquid is centrifuged to remove coarse particles. Thereafter, the thus treated mixture is filtered under pressure through a microfilter (product of Fuji Film Co., Ltd.) having a pore size of 3.0 μm, and ion-exchanged water is added to obtain a pigment dispersion liquid A such that the content of the pigment in the pigment dispersion liquid A becomes 15.0% by mass.

The preparation of the water-dispersible resin dispersion liquid B will be described. 0.8 parts of styrene, 14.4 parts of ethyl methacrylate, 2.7 parts of methyl methacrylate, 2.0 parts of n-hexadecane, and 2.0 parts of 2,2'-azobis-(2-methylbutyronitrile) are mixed and agitated for 30 minutes. The mixed solution is added dropwise to 76.1 parts of a solution of a surfactant Nikkol BC15 (manufactured by Nikko Chemicals) of 5.0% by mass and agitated for 30 minutes. The mixture is then dispersed using an ultrasonic irradiator S-150D Digital Sonifier (product of Branson Ultrasonics Corporation) under a condition of 400 W and 20 kHz for three hours, and subjected to a polymerization reaction under a nitrogen atmosphere at 80° C. for four hours to obtain a water-dispersible resin dispersion liquid. Ion-exchanged water is added to this dispersion, the resultant is then concentrated in an evaporator to obtain the water-dispersible resin dispersion liquid B having a water-dispersible resin content of 35.0% by mass. The minimum film-forming temperature of the water-dispersible resin dispersion liquid B measured according to JISK6828-2:2003 is 55° C.

In the present exemplary embodiment, the water-dispersible resin means resin particles dispersed in a solvent in a state of having a particle size, such as emulsion. The 50% cumulative volume average particle diameter (D50) of the water-dispersible resin is preferably 10 nm or more and 1,000 nm or less. Further, D50 is more preferably 50 nm or more and 500 nm or less. In the present exemplary embodiment, D50 of the water-dispersible resin is measured by the following method.

A dispersion of water-dispersible resin is diluted 50 times (volume basis) with pure water, and measured using UPA-EX150 (manufactured by Nikkiso Co., Ltd.) under conditions of SetZero: 30 s, the number of measurement times: 3 times, measurement time: 180 seconds, and refractive index: 1.5. The polystyrene-equivalent weight average molecular weight obtained by gel permeation chromatography (GPC) of the water-dispersible resin is preferably 1,000 or more and 2,000,000 or less.

Further, the minimum film-forming temperature of the water-dispersible resin is preferably 0° C. or higher and 200° C. or lower, and is more preferably 20° C. or higher and 180° C. or lower taking account of the film-forming property and stability when heat is applied from the heating section. To measure the minimum film forming temperature of the resin particles in the present exemplary embodiment, the ink is applied onto a simple film forming temperature device (product of Imoto Machinery Co., Ltd.) using blade coating, and then the minimum film forming temperature is measured according to JISK6828-2:2003 (Part 2 of Synthetic Resin Emulsion: Determination of white point temperature and minimum film-forming temperature). Specifically, a liquid containing resin fine particles is applied by a 0.3 mm applicator, the applied face is left for 30 minutes to dry the liquid, and then a temperature at which rubbing of the applied face by a glass rod makes scratches is determined as the minimum film-forming temperature. In the present exemplary embodiment, a molten state of the resin after the liquid components have escaped from the sheet surface is important. Therefore, since the minimum film-forming temperature of the resin particles in the present exemplary embodiment does not mean the result measured in the ink form, but means the temperature of the resin particles themselves, the minimum film-forming temperature has to be measured in a state where no solvent or the like is mixed.

In the present exemplary embodiment, any water-dispersible resin can be used for the ink as long as the water-dispersible resin satisfies the above definition of water-dispersible resin. In the water-dispersible resin, any monomer can be used as long as the monomer can be polymerized by an emulsion polymerization method, a suspension polymerization method, a dispersion polymerization method, or the like. Examples of the water-dispersible resin include acrylic, vinyl acetate, ester, ethylene, urethane, synthetic rubber, vinyl chloride, vinylidene chloride, and olefin water-dispersible resins having different monomers, among which an acrylic water-dispersible resin or a urethane water-dispersible resin is preferably used.

Examples of the structure of the water-dispersible resin include resin particles of a single layer structure and a water-dispersible resin having a multilayer structure such as a core-shell structure. In the present exemplary embodiment, it is preferable to use a water-dispersible resin having a multilayer structure. In particular, when the water-dispersible resin has a core-shell structure, a core portion and a shell portion are clearly separated in function, so that it is more preferable to use a water-dispersible resin having the core-shell structure.

The water-dispersible resin having the core-shell structure has a benefit and an advantage that it can impart more functions to the ink than the water-dispersible resin having a single-layer structure.

The content of water-dispersible resin in the ink is preferably 0.1% by mass or more and 10.0% by mass or less, and more preferably 0.2% by mass or more and 4.0% by mass or less with reference to the total mass of the ink.

OPERATION EXAMPLE

A print operation of the printing apparatus 100 under the control of the control unit 9 will be described with reference to FIGS. 1, 3A, and 3B. An operation in a case of printing an image on one side of the printing medium 8 will be described with reference to FIGS. 3A and 3B. The operation in the case where one side of the printing medium 8 is heated once after a print operation will be described. The conveying unit 4 conveys the printing medium 8, on which ink has been ejected by the printhead 1, so that the printing medium 8 passes through the heating section 5. Here, the conveyance route switching unit 11 is set at a position illustrated by a solid line in FIG. 3A. Therefore, after a leading edge of the printing medium 8 passes through the middle point M2, the printing medium 8 is conveyed in a direction indicated by an arrow A in the drawing (that is, a direction toward the sheet discharge tray 7). That is, in a case where the printing medium 8 is heated only once for one printing operation on the printing medium 8, the conveying unit 4 is controlled such that the conveying unit 4 guides the printing medium 8 from the main route RT1 to the main route RT2.

An operation in a case where one side of the printing medium 8 is heated twice after a print operation will be described. The conveying unit 4 conveys the printing medium 8, on which ink has been ejected by the printhead 1 such that the printing medium 8 passes through the heating section 5. Here, the conveyance route switching unit 11 is set at a position illustrated by a solid line in FIG. 3B. Therefore, after the leading edge of the printing medium 8 passes through the middle point M2, the printing medium 8 is conveyed in a direction indicated by an arrow B in the drawing, that is, conveyed to the conveyance route 12. The printing medium 8 is guided through the conveyance route 12, and to the heating section 5 again after the leading edge of the printing medium 8 passes through the middle point M1. Since the conveying unit 4 conveys the printing medium 8 along the conveyance route 12, the surface having been heated by the heat roller 5A when the printing medium 8 passed through the heating section 5 for the first time is heated again. After that, in a case where the printing medium 8 is conveyed after heating twice, the control unit 9 switches the positions of the conveyance route switching unit 11 to the position illustrated by the solid line in FIG. 3A. Therefore, the printing medium 8 is conveyed in the direction indicated by the arrow A in the drawing after the leading edge passes through the middle point M2. Accordingly, the conveying unit 4 conveys the printing medium 8 such that the printing medium 8 passes through the same heating section 5 twice without reversing the front and back of the printing medium 8 by the conveyance route switching unit 11 and the conveyance route 12. In other words, in a case where heating is performed a plurality of times for one printing operation, the conveying unit 4 guides the printing medium 8 heated by the heating section 5 from the main route RT1 to the sub route RT3 so that the printing medium 8 is heated again by the heating section 5, and then guides the printing medium 8 to the main route RT2.

In the above-described exemplary embodiment, in the printing apparatus 100, the printing medium 8 is conveyed in the conveyance route 12 without reverse of the front and back of the printing medium 8. Thus, the same heating section 5 can heat the same surface of the printing medium 8 (the surface on which the ink has been ejected) a plurality of times. Therefore, it is possible to evaporate the liquid components such as water and solvent included in ink by the first heating, and form a film of the water-dispersible resin by the second heating. As a result, the printing apparatus 100 of the present exemplary embodiment can achieve abrasion resistance by the single heating section 5.

The conveyance route 12 is illustrated as a conveyance route that allows the printing medium 8 to pass through the heating section 5 a plurality of times, but other configurations are possible. For example, the conveyance route 12 can be a conveyance route that passes through the printhead 1 with the middle point M1 provided upstream with respect to the printhead 1. In this case, the control unit 9 controls the print operation such that ink is not ejected from the printhead 1 when the printing medium 8 passes under the printhead 1 after passing through the conveyance route 12.

In the present exemplary embodiment, the heating temperature of the heating section 5 can be changed between heating for the first time, and the second and subsequent times. For example, the heating temperature can be controlled to be relatively high when the printing medium 8 passes through the heating section 5 in order to form a film of the water-dispersible resin as described above. This control facilitates film formation of the water-dispersible resin, and thus the desired abrasion resistance can be achieved.

Further, in the present exemplary embodiment, a nip pressure in the heating section 5 can be changed between heating for the first time and the second and subsequent times. For example, the nip pressure can be controlled to be relatively high when the printing medium 8 passes through the heating section 5 in order to form a film of the water-dispersible resin as described above. This control improves the heat transfer efficiency and the smoothness of a surface layer of the printing medium 8, and thus the desired abrasion resistance can be achieved. The control of the nip pressure can be realized by, for example, changing a pressing force of a spring (not illustrated) that presses one of the heat roller 5A and the pinch roller 5B in FIGS. 3A and 3B against the other. Alternatively, the control can be realized by changing the position of a motor (not illustrated) that moves one of the heat roller 5A and the pinch roller 5B toward the other.

Figure 4:
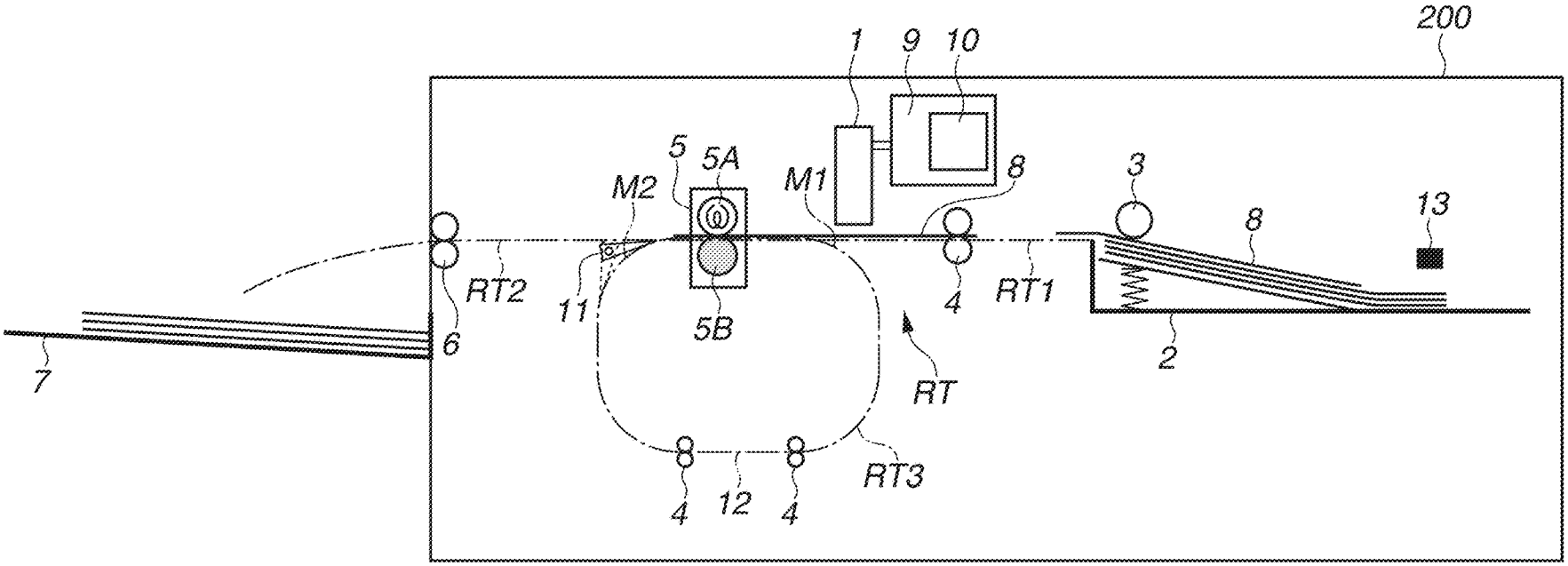
FIG. 4 is an overall view of a printing apparatus according to a second exemplary embodiment.

A second exemplary embodiment will be described. As illustrated in FIG. 4, a printing apparatus 200 of the present exemplary embodiment includes a paper type detection sensor 13 (an example of a detection unit) that detects a type of the printing medium 8. The paper type detection sensor 13 optically detects characteristics of respective paper types based on spectral reflectivity.

At the time of detection, light emitted by a light emitting element is reflected on the printing medium 8, and the paper type detection sensor 13 detects the amount of the reflected light by a light receiving element to determine a type thereof from the light amount level. Therefore, when the light amount is detected with the printing medium 8 stopped or conveyed at an extremely low speed, the variation of the light amount level is small, allowing accurate detection. In the present exemplary embodiment, the paper type detection sensor 13 is provided on the upstream side with respect to the sheet feeding cassette 2. Thus, the paper type detection sensor 13 can detect the light amount when the printing medium 8 is stopped.

In the present exemplary embodiment, the control unit 9 sets one operation mode among a plurality of operation modes according to the type of the printing medium 8. The control unit 9 can determine the number of times of passage of the printing medium 8 through the heating section 5 after an image has been printed thereon based on the set operation mode. Since there are the printing media 8 of various types, the amount of coloring material fixed on the surface layer of the printing medium 8 and the film forming state of the water-dispersible resin after a passage of the printing medium 8 through the heating section 5 differ among the printing media 8. Thus, the abrasion resistance is different due to the types of the printing medium 8. Therefore, in the present exemplary embodiment, the type of the printing medium 8 is detected by the paper type detection sensor 13 and the number of times of its passage through the heating section 5 is determined such that the film formability of the water-dispersible resin is within a desired range regardless of the type of the printing medium 8.

Each operation mode that can be set by the control unit 9 will be described with reference to FIG. 5. FIG. 5 illustrates a table indicating a correspondence among operation modes, operations, and determination criteria. The table is stored in the ROM 102 or the RAM 103 as a database. For each operation mode, the number of times of a passage of the printing medium 8 through the heating section 5 is set based on information about the type of printing medium 8 temporarily stored in the RAM 103 or information about the type of printing medium 8 stored in advance in the ROM 102. A first operation mode is a mode where a surface of the printing medium 8 on which ink has been ejected is made to pass through the heating section 5 only once for one printing operation by the printhead 1. A second operation mode is a mode where a surface of the printing medium 8 on which ink has been ejected is made to pass through the heating section 5 a plurality of times, that is, twice or more times for one printing operation by the printhead 1. A third operation mode is a mode where a user can set the number of times of a passage of the printing medium 8 through the heating section 5 for one printing operation by the printhead 1 to any number. For example, the control unit 9 can receive the number of times of a passage of the printing medium 8 through the heating section 5 from the operating unit 10 by an input operation of a user.

Figure 6:
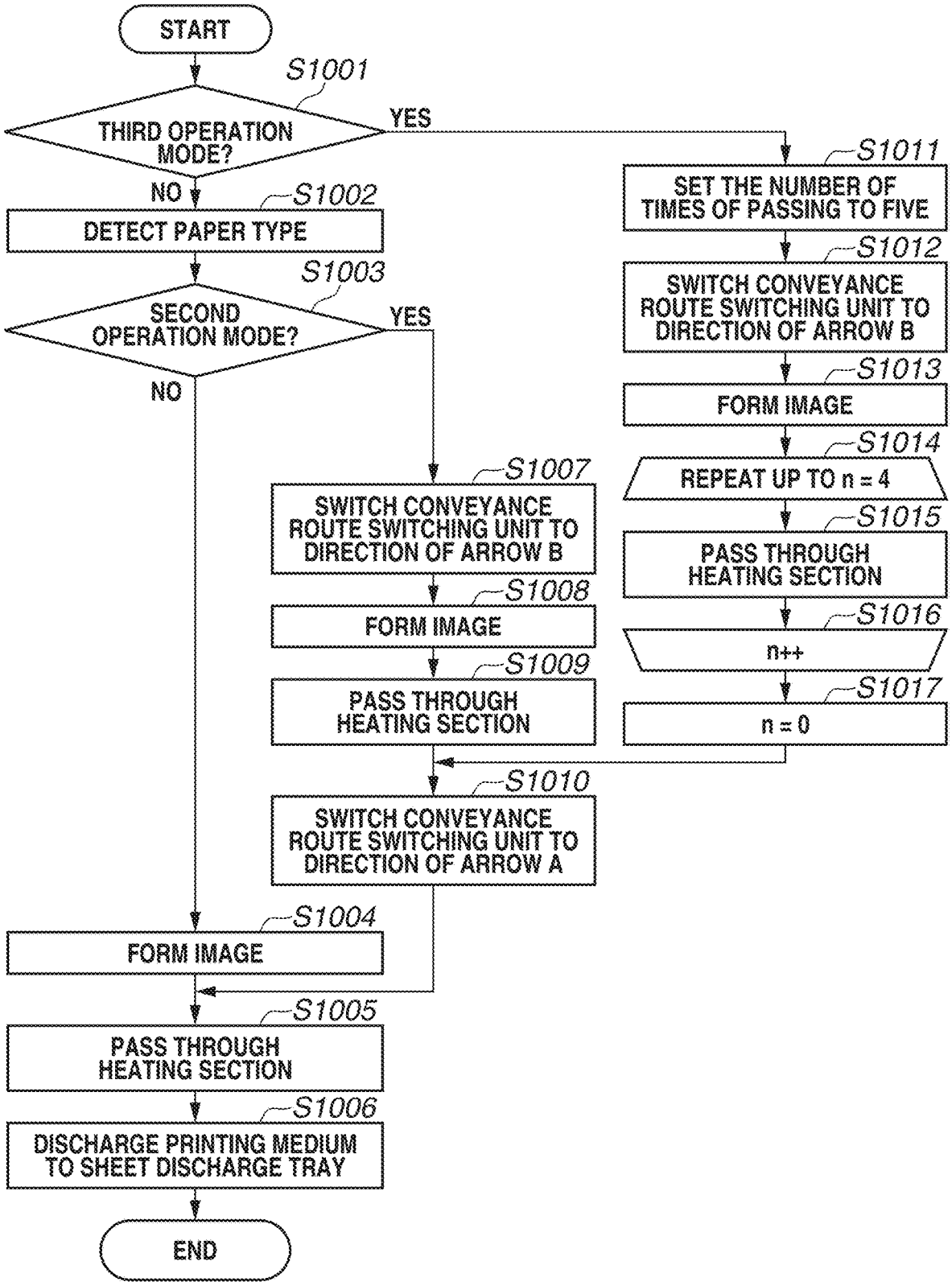
FIG. 6 is a flowchart illustrating an operation according to the second exemplary embodiment.

With reference to a flowchart of FIG. 6, the details of the control of the present exemplary embodiment, that is, the details of operations in each operation mode will be described. Each control is performed by the CPU 101 of the control unit 9.

In step S1001, the control unit 9 determines whether the operation mode currently set is the third operation mode.

In a case where the third operation mode is not set (No in step S1001), in step S1002, the control unit 9 detects a type of the printing medium 8 by the paper type detection sensor 13. Here, a case where the third operation mode is not set includes a case where the number of times of a passage of the printing medium 8 through the heating section 5 is not set by a user.

In step S1003, the control unit 9 selects an operation mode suitable for the printing medium 8 detected by the paper type detection sensor 13. That is, the control unit 9 selects the first operation mode in a case where a predetermined abrasion resistance can be achieved by a passage of the printing medium 8 through the heating section 5 once (No in step S1003). On the other hand, the control unit 9 selects the second operation mode in a case where the predetermined abrasion resistance cannot be achieved by a passage of the printing medium 8 through the heating section 5 only once (Yes in step S1003). Here, the control unit 9 determines whether the predetermined abrasion resistance can be achieved based on an abrasion resistance level of each printing medium type. The abrasion resistance level of each printing medium type is stored in the ROM 102 in advance in association with the printing medium type. In a case where the control unit 9 determines that a predetermined abrasion resistance can be achieved by one heating operation referring to the printing medium 8 detected by the paper type detection sensor 13 and the abrasion resistance level stored in the ROM 102, the control unit 9 selects the first operating mode. On the other hand, in a case where the control unit 9 determines that a predetermined abrasion resistance cannot be achieved by one heating operation referring to the printing medium 8 detected by the paper type detection sensor 13 and the abrasion resistance level stored in the ROM 102, the control unit 9 selects the second operating mode.

In steps S1004 to S1006, processing in a case where the first operation mode is selected in step S1003 will be described. The control unit 9 switches the conveyance route switching unit 11 such that the printing medium 8 is conveyed in the direction of the arrow A. In step S1004, an image is printed on the printing medium 8. In step S1005, the control unit 9 causes the printing medium 8 to pass through the heating section 5. The surface of the printing medium 8 on which the image has been printed is heated by the heating section 5. In step S1006, the control unit 9 discharges the printing medium 8 to the sheet discharge tray 7.

In steps S1007 to S1010, processing in a case where the second operation mode is selected in step S1003 will be described.

In step S1007, the control unit 9 switches the conveyance route switching unit 11 such that the printing medium 8 is conveyed in the direction of the arrow B.

In step S1008, an image is printed on the printing medium 8 by the printhead 1, and in step S1009, the liquid components such as water and solvent included in the ink are evaporated by a passage of the printing medium 8 through the heating section 5.

In step S1010, the conveyance route switching unit 11 is switched such that the printing medium 8 is conveyed in the direction of the arrow A after a trailing edge of the printing medium 8 passes through the middle point M2. The determination as to whether the trailing edge of the printing medium 8 has passed through the middle point M2 is made by a sensor for detecting the trailing edge of the printing medium 8 at the middle point M2. The determination method is not limited to this, and the determination can be made based on calculation from an elapsed time from the printing based on the information about the conveyance speed of the printing medium 8. After that, in step S1005, the control unit 9 causes the printing medium 8 to pass through the same heating section 5 so that the heating section 5 heats the same surface of the printing medium 8 again and a film of water-dispersible resin is formed. In step S1006, the control unit 9 discharges the printing medium 8 to the sheet discharge tray 7. By such control, a desired abrasion resistance can be exhibited.

In steps S1011 to S1017, the processing in a case where the operation mode currently set is the third operation mode (Yes in step S1001) will be described. The third operation mode is an operation mode in a case where a user sets the number of times of a passage of the printing medium 8 through the heating section 5 to an arbitrary number. The number of times of a passage of the printing medium 8 through the heating section 5 is input from the operating unit 10 by a user operation, for example. The input number of times thereof can be temporarily stored in the RAM 103.

In the present exemplary embodiment, a case where the user sets the number of times of a passage of the printing medium 8 through the heating section 5 to five will be described as an example. In step S1011, the control unit 9 acquires the number of times of a passage of the printing medium 8 through the heating section 5 stored in the RAM 103 and sets the acquired number as the number of times thereof.

In step S1012, the control unit 9 switches the conveyance route switching unit 11 such that the printing medium 8 is conveyed in the direction of the arrow B.

In step S1013, an image is printed on the printing medium 8 by the printhead 1. After that, in steps S1014 to S1016, the control unit 9 repeatedly makes the printing medium 8 pass through the heating section 5 in step S1015 based on the number of times of a passage of the printing medium 8 through the heating section 5 set in step S1011.

In step S1017, the control unit 9 resets a count when the number of times of a passage of the printing medium 8 through the heating section 5 in step S1014 reaches four times. The control unit 9 then performs the processing in the order of step S1010, step S1005, and step S1006. In step S1005, the fifth heating is performed by making the printing medium 8 pass through the heating section 5, and in step S1006, the printing medium 8 is discharged to the sheet discharge tray 7.

In step S1002, the control unit 9 detects a type of the printing medium 8 by the paper type detection sensor 13. However, detection can be performed in other ways. The type of printing medium 8 can be received from the operating unit 10 by the input operation of a user and stored in the RAM 103. Then, the control unit 9 can set an operation mode such that the predetermined number of times of a passage of the printing medium 8 through the heating section 5 is achieved based on the information about the type of the printing medium 8 stored in the RAM 103.

In addition, also in the present exemplary embodiment, the heating temperature of the heating section 5 can be changed between heating for the first time and the second and subsequent times, similarly to the first exemplary embodiment.

Further, also in the present exemplary embodiment, the nip pressure at the heating section 5 can be changed between heating for the first time and the second and subsequent times, similarly to the first exemplary embodiment.

As described above, in the present exemplary embodiment, the number of times of heating can be changed according to the operation mode. Therefore, regardless of a type of a printing medium, it is possible to achieve water removal and a predetermined abrasion resistance.

A third exemplary embodiment will be described. The present exemplary embodiment is different from the second exemplary embodiment in that a cleaning mode can be performed. When the liquid components such as water and solvent included in the ink are evaporated while the printing medium 8 to which the ink has been applied passes through the heating section 5, the solvent adheres to the surface layer of the heating section 5. Therefore, the surface energy of the surface layer of the heating section 5 increases, and the coloring material of the surface layer of the heating section 5 may be transferred to the printing medium 8 when the printing medium 8 passes through the heating section 5 thereafter. In order to suppress such unintended transfer, a printing apparatus of the third exemplary embodiment counts a cumulative value of an amount of ink adhering to the heating section 5, and cleans the heating section 5 based on the result of comparison with a predetermined threshold value.

In the second exemplary embodiment, in the second operation mode and the third operation mode described above (that is, operation modes in which the printing medium 8 is made to pass through the heating section 5 a plurality of times), the solvent adhering to the surface layer of the heating section 5 when the printing medium 8 passes through the heating section 5 for the first time is transferred to the printing medium 8 when the printing medium 8 passes through the heating section 5 for the second time and subsequent times. Thus, the solvent on the surface layer of the heating section 5 scarcely accumulates. On the other hand, in the first mode, the printing medium 8 passes through the heating section 5 after printing and then is discharged. Thus, solvent that adheres to the surface layer of the heating section 5 when the liquid components, such as water and the solvent included in the ink, evaporate is not transferred to the printing medium 8 but accumulates.

The printing apparatus can operate in a cleaning mode. A heating section cleaning mode of the present exemplary embodiment is a mode for suppressing an occurrence of image degradation during heating due to the accumulation of stains on the surface layer of the heating section 5.

Figure 7:
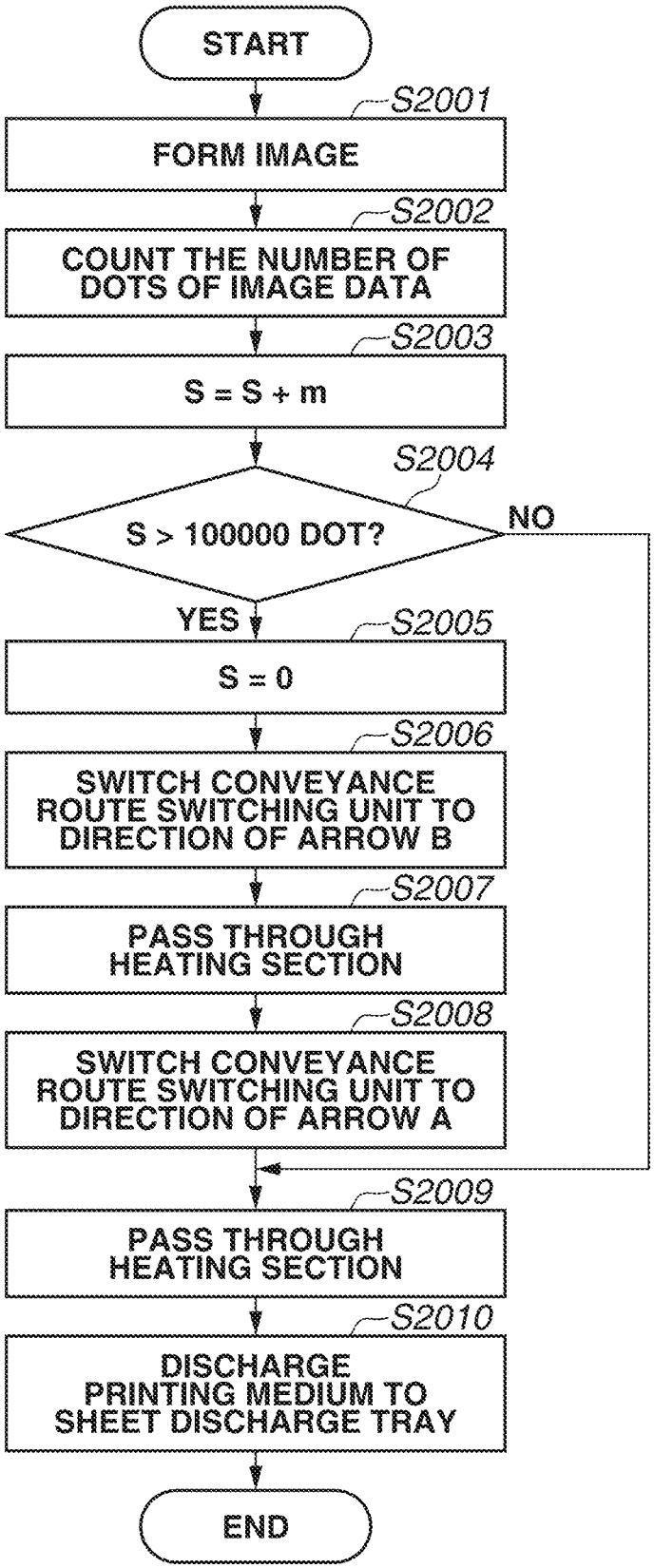
FIG. 7 is a flowchart illustrating an operation according to a third exemplary embodiment.

Details of the control of the present exemplary embodiment will be described with reference to the flowchart of FIG. 7. FIG. 7 is premised on the first operation mode, that is, a case where the printing medium 8 is made to pass through the heating section 5 only once for one printing operation by the printhead 1.

In step S2001, the control unit 9 causes the printhead 1 to form an image on the printing medium 8. In step S2002, the control unit 9 performs dot count of image data ejected onto the printing medium 8 by the printhead 1. The control unit 9 counts the number of ink ejections (that is, an ink ejection amount) by the printhead 1.

In step S2003, the control unit 9 adds the ink ejection amount (dot count value) by the printhead 1 as a cumulative dot count S. In step S2004, the control unit 9 determines whether the cumulative dot count S exceeds a predetermined threshold value. In the present exemplary embodiment, the threshold value of the number of dots is set to 100000 dots, but the threshold number can be set to any number based on the degree of accumulation of stains on the heating section 5.

In step S2008, the control unit 9 switches the conveyance route switching unit 11 such that the printing medium 8 is conveyed in the direction of the arrow A when the trailing edge of the printing medium 8 passes through the conveyance route switching unit 11. After that, in step S2009, the printing medium 8 passes through the heating section 5, and in step S2010, the printing medium 8 is discharged to the sheet discharge tray 7.

As described above, in a case where the first operation mode is set, image degradation such as transfer of coloring materials may happen due to the change of the surface energy of the surface layer of the heating section 5 when the cumulative value of the dot counts of the image data exceeds the predetermined threshold value. In the present exemplary embodiment, such image degradation can be suppressed.

The present disclosure has been described above by taking the above-described exemplary embodiments as examples, but the technical scope of the present disclosure is not limited to the above-described exemplary embodiments. The present disclosure is not limited to each of the above-described exemplary embodiments, and can be appropriately modified within the scope of the claims and a range equivalent to the scope as long as the modification is based on the technical idea of the present disclosure.

The printhead 1 of each exemplary embodiment has been described as a full-line type head, but the same effect can be obtained even if the printhead 1 is a serial type head.

In each exemplary embodiment, a case of single-sided printing has been described as an example, but each exemplary embodiment can be applied to a case of double-sided printing.

A plurality of printheads 1 can be provided to correspond to a plurality of inks having different printing colors or densities. For example, the operation mode of the printing apparatus is not limited to the operation mode of only a major color such as black, but the printing apparatus can have at least one of a print mode of multicolor including different colors or a print mode of the full-color formed by color mixing. In this case, an ink application amount that allows sufficient dry of the ink (to be more precise, all the ink droplets forming the image are dried) when the printing medium 8 passes through the heating section 5 after the ink has landed on the printing medium 8 is preferable.

The ink can mainly contain a colorant (dye or pigment) and a solvent component. The solvent component can be either an aqueous material or an oil material. As the dye, for example, a water-soluble dye represented by a direct dye, an acid dye, a basic dye, a reactive dye, a food dye, and the like is preferable, and any dye can be used as long as it provides an image satisfying the required performance such as fixability, color resistance, clarity, stability, and light resistance in combination with the above-mentioned printing medium. Carbon black or the like is preferable as the pigment. As a method of using both a pigment and a dispersant, a method of using a self-dispersible pigment or a method of microencapsulation can also be possible. In addition, various additives such as a solvent component, a solubilizing agent, a viscosity modifier, a surfactant, a surface tension modifier, a pH modifier, and a specific resistance modifier can be added to the ink as needed.

As described above, the present specification has been described referring to the first to third exemplary embodiments, but an aspect obtained by combining a part or whole of the exemplary embodiments is also included in the technical scope of the present disclosure.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-180290, filed Sep. 30, 2019, which is hereby incorporated by reference herein in its entirety.

What is claimed is:

1. A printing apparatus for a film formation process, the printing apparatus comprising:

a conveyance unit configured to convey a printing medium along a conveyance direction;

a printing unit configured to eject ink having film-forming properties onto a first surface of the printing medium conveyed by the conveyance unit;

a heating unit provided on a downstream side with respect to the printing unit in the conveyance direction and is configured to heat the printing medium, onto which the ink has been ejected, while the heating unit is in contact with the printing medium; and a control unit configured to control the conveyance unit so that the first surface of the printing medium having the ink faces a heating element of the heating unit and is heated by the same heating element a plurality number of times without passing under the printing unit, to form a film on the printing medium, and to control, to achieve a predetermined abrasion resistance by a single heating unit without reverse of a front and back of the printing medium, the heating unit to evaporate water and solvent included in the ink on the first surface by a first heating of the printing medium, and to form a film of a water-dispersible resin on the first surface by a second heating of the same surface of the printing medium, using a higher heating temperature and nip pressure than a heating temperature and nip pressure used in the first heating.

2. The printing apparatus according to claim 1, further comprising a conveyance route that connects an upstream side and a downstream side with respect to the heating unit in the conveyance direction without passing through the heating unit.

3. The printing apparatus according to claim 2, wherein, to form the film on the printing medium, the control unit causes the first surface of the printing medium having the ink to pass through the heating unit so that the first surface is heated, and then causes the printing medium to be conveyed to the upstream side with respect to the heating unit through the conveyance route, and causes the first surface to pass through the heating unit again.

4. The printing apparatus according to claim 1, wherein the ink ejected onto the printing medium by the printing unit includes at least a water-dispersible resin.

5. The printing apparatus according to claim 4, wherein heating the water-dispersible resin contained in the ink by the heating unit forms the water-dispersible resin into the film on the printing medium.

6. The printing apparatus according to claim 1 further comprising a setting unit configured to set one of a plurality of operation modes including at least a first operation mode and a second operation mode, wherein, in a case where the first operation mode is set, the control unit causes the printing medium to pass through the heating unit only once for one printing operation by the printing unit, and wherein, in a case where the second operation mode is set, the control unit causes the printing medium to pass through the heating unit the plurality number of times including twice for one printing operation by the printing unit.

7. The printing apparatus according to claim 6, wherein the setting unit sets one operation mode among the plurality of operation modes based on a type of the printing medium.

8. The printing apparatus according to claim 7 further comprising a detection unit configured to detect the type of the printing medium by a sensor, wherein the setting unit sets one operation mode among the plurality of operation modes based on the type of the printing medium detected by the detection unit.

9. The printing apparatus according to claim 7 further comprising a memory unit configured to store the type of the printing medium based on an input operation by a user, wherein the setting unit sets one operation mode among the plurality of operation modes based on the type of the printing medium stored in the memory unit.

10. The printing apparatus according to claim 6 further comprising a counting unit configured to count an ink ejection amount in a printing operation by the printing unit, wherein, in a case where the first operation mode is set and the ink ejection amount counted by the counting unit exceeds a predetermined threshold value, the control unit controls the printing apparatus so that the printing medium passes through the same heating unit again.

11. The printing apparatus according to claim 1, wherein the plurality number of times the first surface of the printing medium is heated by the heating unit is predetermined such that a film formability of the water-dispersible resin in the ink is within a desired range regardless of a type of the printing medium, and wherein the same heating unit is used for each heating in the film formation process such that the printing apparatus is smaller than in a case where a plurality of heating units is arranged in the conveyance direction to heat a printing medium.

12. The printing apparatus according to claim 11, wherein the plurality number of times is predetermined based on a speed in which the ink penetrates the printing medium such that the film formability of the water-dispersible resin in the ink is within the desired range regardless of the type of the printing medium.

13. A method for a printing apparatus for a film formation process, wherein the printing apparatus includes a conveyance unit, a printing unit, and a heating unit provided on a downstream side with respect to the printing unit in a conveyance direction, the method comprising:

conveying, via the conveyance unit, a printing medium along the conveyance direction;

ejecting, via the printing unit, ink having film-forming properties onto a first surface of the printing medium conveyed by the conveyance unit;

heating, via the heating unit, the printing medium, onto which the ink has been ejected, while the heating unit is in contact with the printing medium;

controlling the conveyance unit so that the first surface of the printing medium having the ink faces a heating element of the heating unit and is heated by the same heating element a plurality number of times without passing under the printing unit, to form a film on the printing medium; and controlling, to achieve a predetermined abrasion resistance by a single heating unit without reverse of a front and back of the printing medium, the heating unit to evaporate water and solvent included in the ink on the first surface by a first heating of the printing medium, and to form a film of a water-dispersible resin on the first surface by a second heating of the same surface of the printing medium, using a higher heating temperature and nip pressure than a heating temperature and nip pressure used in the first heating.

14. A non-transitory computer-readable storage medium storing a program to cause a computer to perform a method for a printing apparatus for a film formation process, wherein the printing apparatus includes a conveyance unit, a printing unit, and a heating unit provided on a downstream side with respect to the printing unit in a conveyance direction, the method comprising:

conveying, via the conveyance unit, a printing medium along the conveyance direction;

ejecting, via the printing unit, ink having film-forming properties onto a first surface of the printing medium conveyed by the conveyance unit;

heating, via the heating unit, the printing medium, onto which the ink has been ejected, while the heating unit is in contact with the printing medium;

controlling the conveyance unit so that the first surface of the printing medium having the ink faces a heating element of the heating unit and is heated by the same heating element a plurality number of times without passing under the printing unit, to form a film on the printing medium; and controlling, to achieve a predetermined abrasion resistance by a single heating unit without reverse of a front and back of the printing medium, the heating unit to evaporate water and solvent included in the ink on the first surface by a first heating of the printing medium, and to form a film of a water-dispersible resin on the first surface by a second heating of the same surface of the printing medium, using a higher heating temperature and nip pressure than a heating temperature and nip pressure used in the first heating.

15. A printing apparatus for a film formation process, the printing apparatus comprising:

a conveyance unit configured to convey a printing medium along a conveyance direction;

a printing unit configured to eject ink having film-forming properties onto a first surface of the printing medium conveyed by the conveyance unit;

a heating unit provided on a downstream side with respect to the printing unit in the conveyance direction and is configured to heat the printing medium onto which the ink has been ejected, while the heating unit is in contact with the printing medium; and a control unit configured to control the conveyance unit so that the first surface of the printing medium having the ink faces a heating element of the heating unit and is heated by the same heating element in a plurality of heating operations without passing under the printing unit, to form a film on the printing medium, the plurality of heating operations including a first heating operation having one or more passes under the heating unit so that liquid components are evaporated from the ink and a second heating operation having one or more passes under the heating unit such that liquid evaporation and film formation are performed in multiple heating operations so that the film formed on the printing medium has a predetermined abrasion resistance.

16. A printing apparatus for a film formation process, the printing apparatus comprising:

a conveyance unit configured to convey a printing medium along a conveyance direction;

a printing unit configured to eject ink having film-forming properties onto a first surface of the printing medium conveyed by the conveyance unit;

a heating unit provided on a downstream side with respect to the printing unit in the conveyance direction and is configured to heat the printing medium onto which the ink has been ejected, while the heating unit is in contact with the printing medium; and a control unit configured to control the conveyance unit so that the first surface of the printing medium having the ink faces a heating element of the heating unit and is heated by the same heating element a plurality number of times without passing under the printing unit, to form a film on the printing medium, and to control an evaporation process on the ink (i) so that polymer particles in the ink are not dissolved after liquid components included in the ink are evaporated and (ii) so that the polymer particles do not penetrate into the printing medium before formation of the film starts.

* * * * *